US005795464A

United States Patent [19]

Sankey et al.

[11] Patent Number: 5,795,464

[45] Date of Patent: Aug. 18, 1998

[54] CONVERSION OF THE ORGANIC COMPONENT FROM TAR SANDS TO LOWER BOILING PRODUCTS

[75] Inventors: Bruce M. Sankey, Calgary, Canada; Peter S. Maa; Roby Bearden, Jr., both of Baton Rouge, La.

[73] Assignee: Exxon Research and Engineering Company, Florham Park, N.J.

[21] Appl. No.: 753,459

[22] Filed: Nov. 25, 1996

Related U.S. Application Data

[63] Continuation-in-part of Ser. No. 326,402, Oct. 19, 1994, abandoned.

[51] Int. Cl.[6] ..... C01G 1/00; C01G 1/04; C01G 9/34

[52] U.S. Cl. ..... 208/391; 208/390; 208/131; 208/127; 208/126; 208/106; 208/44; 208/42; 208/411

[58] Field of Search ..... 208/40, 42, 43, 208/44, 106, 131, 132, 400, 411, 390, 391, 126, 127

[56] References Cited

U.S. PATENT DOCUMENTS

| | | | |
|---|---|---|---|
| 4,088,562 | 5/1978 | O'Ffill | 208/11 R |
| 4,427,529 | 1/1984 | Nishio | 208/11 R |
| 4,477,331 | 10/1984 | Reed et al. | 208/8 R |
| 4,818,370 | 4/1989 | Gregoli et al. | 208/106 |
| 4,994,172 | 2/1991 | Buchanan et al. | 208/106 |
| 5,316,664 | 5/1994 | Gregoli et al. | 208/390 |

*Primary Examiner*—Bekir L. Yildirim
*Attorney, Agent, or Firm*—Henry R. Naylor

[57] ABSTRACT

A process for the thermal conversion of the organic component associated with tar sands to lower boiling, higher value products. The conversion is achieved by subjecting the organic component containing from about 1 to 20 wt. % native solids to elevated temperatures and pressures. Compared to conventional thermal conversion processes, such as visbreaking, much higher conversion of the organic component can be achieved owing to the presence of native solids on which coke is deposited instead of fouling the process equipment. This higher conversion is also associated with enhanced removal of sulfur and metals.

5 Claims, 2 Drawing Sheets

CONVERSION OF THE ORGANIC COMPONENT FROM TAR SANDS TO LOWER BOILING PRODUCTS

CROSS REFERENCE TO RELATED APPLICATIONS

This case is a continuation-in-part of U.S. Ser. No. 08/326,402, filed Oct. 19, 1994 (abandoned), which is based on Patent Memorandum 94-BR-010.

FIELD OF THE INVENTION

The present invention relates to the thermal conversion of the organic component associated with tar sands to lower boiling, higher value products. The conversion is achieved by subjecting the organic component containing from about 1 to 20 wt. % native solids to elevated temperatures and pressures. Compared to conventional thermal conversion processes, such as visbreaking, much higher conversion of the organic component can be achieved owing to the presence of native solids on which coke is deposited instead of fouling the process equipment. This higher conversion is also associated with enhanced removal of sulfur and metals.

BACKGROUND OF THE INVENTION

The organic component of certain naturally occurring carbonaceous materials, such as tar sands, contains potentially valuable hydrocarbon material. The organic component of tar sands is referred to as bitumen. Bitumen is produced from tar sands by a variety of methods including: (a) injecting steam into a tar sands formation and recovering a bitumen/water/solids stream, (b) various in-situ production techniques whereby water or aqueous surfactants are injected into the tar sands formation and recovering a bitumen/water/solids stream, (c) mining processes wherein overburden is removed and the total tar sands material fed to an extraction step which recovers most of the bitumen as a froth which typically contains 40–60 wt. % bitumen together with water and solids. Method (c) above, with a further separation step, readily produces a stream containing 70+ wt. % bitumen with a significant amount of native solids, and is therefore most suitable for application of this invention. However, the solids content of bitumen recovered by any other processes can easily be increased by the addition of native solids.

Visbreaking, a thermal conversion process, is widely practiced commercially as a means for obtaining low levels of conversion on heavy oils, such as atmospheric resids, or vacuum resids, and bitumen. However, the severity of visbreaking has generally been limited by coke formation which fouls the process equipment. That is, as the temperature, or residence time, is increased to obtain higher conversions, coke-make becomes more and more of a problem. Typical maximum conversion levels for visbreaking bitumen is no more than about 30 to 35% of the (525° C.+) material, which still leaves the bitumen too viscous for pipelining without the use of expensive diluents to drop the viscosity in a range acceptable for pipelining. Higher levels of conversion are not practical because as conversion increases, coke-make also increases. At conversion levels higher than about 30 to 35%, coke-make is so great that fouling of process equipment results.

Various schemes have been proposed for increasing the severity of visbreaking operations. For example, U.S. Pat. No. 4,454,023 proposes to increase the severity of visbreaking by subjecting the heavy fraction to a solvent extraction step to produce an oil fraction, a resin fraction, and an asphaltene fraction. The resin fraction is recycled to the visbreaker thereby permitting an increase in severity. Such an operation uses a conventional deasphalting solvent to produce the product fractions, which are essentially free of asphaltenes. In such an operation, about 40%, or more, of the feed to deasphalting is recovered as asphaltenes. Although higher conversions can be achieved with such a process, its cost is exceedingly high.

Therefore, there is still a need in the art for a process for upgrading heavy oils, particularly those derived from naturally occurring carbonaceous deposits such as tar sands, which overcomes the above disadvantages and which can be operated at high severities to achieve high conversions without fouling process equipment. That is, a visbreaking process with conversions substantially greater than about 30% of the 525° C.+ material so that: i) more valuable liquid products are obtained, ii) the resulting product stream is at low enough viscosity that contained solids are readily removed by conventional means (e.g. settling, drawoff, filtration, etc.), iii) the resulting liquid product stream is at a low enough viscosity to allow direct pipelining, and iv) the resulting liquid product stream contains a much lower level of metals and sulfur.

SUMMARY OF THE INVENTION

In accordance with the present invention, there is provided a process for upgrading the organic component of tar sands to lower boiling products, which process comprises:

a) separating the organic component from the inorganic component of tar sands so that the organic component contains from about 1 to 20 wt. % of inorganic tar sands native solids;

b) subjecting said organic component containing the native solids to temperatures from about 425° to 565° C. and pressures from about atmospheric pressure to about 2,000 psig;

c) collecting a normally liquid hydrocarbonaceous product stream, including inorganic native solids; and d) separating the inorganic native solids from the normally liquid product stream.

In preferred embodiments of the present invention, the mixture contains about 4 to 10 wt. % native solids with the balance being organic material.

In other preferred embodiments of the present invention, up to about 20 wt. % water is present in the mixture of organic component and native solids.

In yet other preferred embodiments of the present invention, the thermal conversion conditions include temperatures from about 425° to 510° C. and pressures from about 100 to 1500 psig.

DETAILED DESCRIPTION OF THE INVENTION

Figure 1:
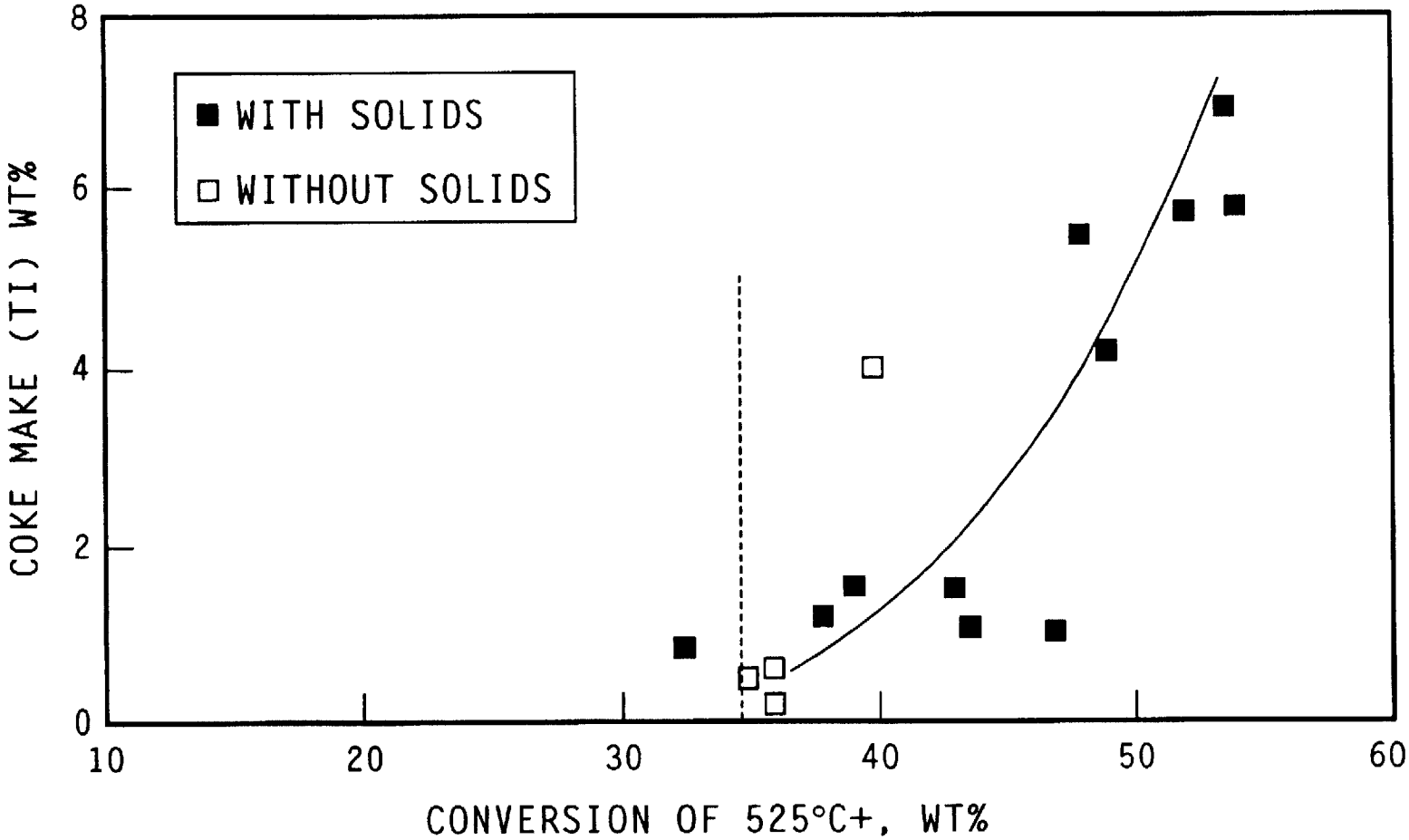
FIG. 1 shows a plot of coke-make versus conversion of the 525° C.+ material in bitumen, for two feeds, namely pure bitumen and bitumen containing 5 to 10 wt. % solids. In the case of pure bitumen, at conversion levels exceeding about 30–35%, coke is formed and deposits on the reactor walls, resulting in reduced heat transfer and increased pressure drop. This situation rapidly translates to plugging of the reactor, and inoperability. In contrast, when the feed contains native solids, coke is still formed, but it deposits on the large surface associated with the solids, rather than on equipment surfaces, thus extending the conversion range well above 50%.
Figure 2:
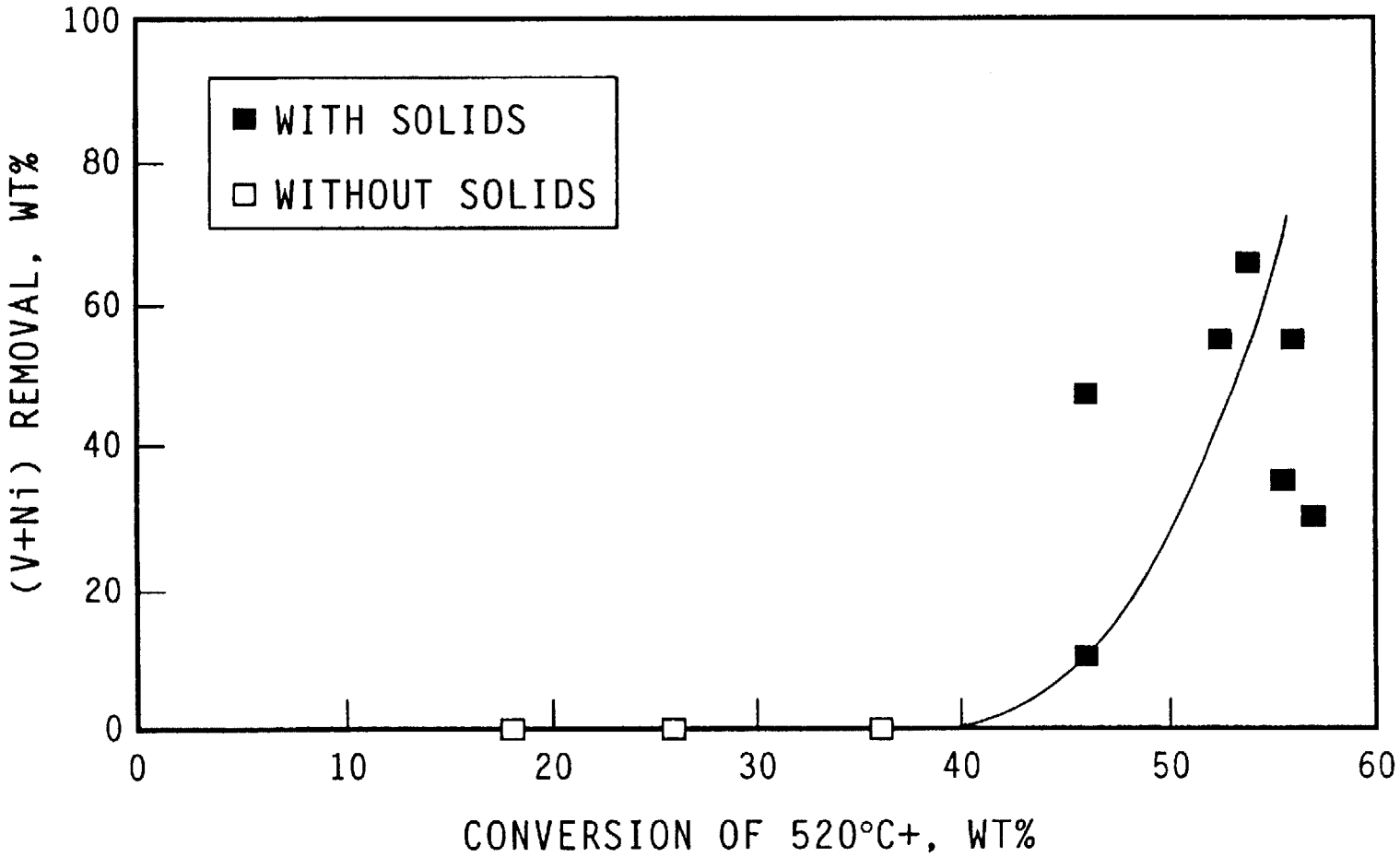
FIG. 2 hereof is a plot of vanadium and nickel removal (wt. %) versus % conversion of the 525° C.+ material of bitumen.

The advantages of the present invention can be obtained in the thermal conversion of the hydrocarbon derived from tar sands, as long as about 1 to 20 wt. %, preferably about 4 to 8 wt. % native solids are present with the organic material during thermal conversion. The term "native solids" as used herein means solid particles which are native to the tar sands. These native solids are the inorganic material, such as sand, clay, or rock. The bulk of these solids comprise silica, silicates, aluminum-silicates and oxides and carbonates of elements such as silica, magnesium, potassium, iron and calcium. Much smaller amounts of oxides, silicates, sulfides and carbonates of elements such as titanium, zinc, tin, copper and manganese are commonly present in Canadian tar sands but detailed composition will, of course, be site-specific. Native solids are normally present in the produced bitumen, because of the way the bitumen is separated from the inorganic portion and because of the nature of the tar sands deposit, which inherently contains a great deal of solid particles. Bitumen derived from tar sands is typically a high boiling immobile organic material which must be converted to lower boiling normally liquid products for transportation and use in conventional refineries to manufacture petroleum products.

Oil shale, unlike tar sands, which is comprised of inorganic particles and an organic fraction and water, can be thought of as a rock with the organic component trapped therein. The organic component of oil shale is referred to as kerogen. The organic component for both tar sands and oil shale is typically 10 wt. % of the sample of naturally occurring material. When oil shale is wet-mined, a mixture of kerogen, native solids, and water is obtained. This mixture can be processed in accordance with the present invention.

Many process variations exist for separating the organic component from the inorganic solid material of naturally occurring carbonaceous deposits, so it can be passed along for conversion to lower boiling products. As previously mentioned, conventional visbreaking techniques cannot achieve the conversion levels of the present invention, primarily because a feed containing substantially no solids results in the fouling of equipment and inoperability at conversion levels exceeding about 30–35%.

Any appropriate thermal visbreaking conditions and apparatus known in the art may be used in the practice of the present invention. Thermal visbreaking is typically performed in a tubular, or coil reactor, although a coil-soaker configuration can also be used. The coil reactor can also be referred to as a plug-flow reactor. A plug-flow reactor system has an infinite number of mixing stages. Thermal conversion conditions include temperatures from about 425° to 565° C., preferably from about 425° to 510° C., and more preferably from about 455° to 485° C. Typical thermal conversion pressures range from about atmospheric pressure to about 2,000 psig, preferably from about 100 to 1,500 psig, and more preferably from about 100 to 1,000 psig. The resulting lower boiling product is collected and subjected to filtration to remove the native solids. It is important to separate the solid material from the normally liquid conversion product because the solids will contain a substantial portion of the metals and sulfur, both of which are undesirable in the final liquid conversion product. All, none, or a portion of the solids can be recycled to the feed mixture, depending on the amount of solids in the feed. The separated solids can of course be discarded by any appropriate means. Any suitable means can be used to separate the solids from the product stream; one such technique is filtration. A preferred filtration technique would be pressure filtration at elevated temperatures. That is, a technique wherein the solids are filtered from the liquid product stream at temperatures from about 200° to 300° C. and pressures from about 50 to 150 psig. In cases where organic feed does not contain enough native solids, they may be added to the feed, recovered by filtration or other means as described above, and recycled in order to minimize the net requirement for additional solids.

As previously mentioned, conventional visbreaking of bitumen only achieves maximum conversion levels of about 30 to 35% because of equipment fouling at high conversions.

Typical results achieved by the present invention are compared with those for conventional visbreaking in Table I, based on pilot plant data using Athabasca bitumen from Canadian tar sands deposits.

TABLE I

| | Feed | Conventional Visbreaking | Present Invention * |
|---|---|---|---|
| Gravity, API | 8 | 11 | 15 |
| Viscosity, cSt/38° C. | 30,000 | 260 | 30 |
| Sulfur, wt % | 4.9 | 4.4 | 3.7 |
| Metals (V + Ni) ppm | 300 | 300 | 126 |
| 525° C.+ Content, wt % | 54 | 38 | 25 |

* After removal of solids

Conventional visbreaking to about 30% conversion gives only marginal improvement in gravity and viscosity, and no improvement in metals since coke formation must be avoided. High viscosity represents a barrier to transporting the product stream, since the typical target for pipeline carriers is below 40 cSt/38° C. The present invention allows higher conversion with much enhanced product quality. Viscosity is reduced down to a level acceptable for long-distance pipelining and the fact that some coke formation is acceptable allows metals to be deposited and thereby removed from the organic component. This can be commercially important because the viscosity of a bitumen product at only 30 to 35% conversion will still be too viscous for direct pipelining and for solids separation by filtration. By the practice of the present invention there is no need to remove all of the solids before passing the organic component to the conversion stage. The viscosity of the product stream will decrease as the percent conversion increases, primarily because the liquid conversion product acts as an in-situ diluent. Further, when conversions are kept in the 30 to 35% range, or below, minimal sulfur and no metals are removed from the organic component. Higher conversion levels, in the presence of native solids, allow for higher levels of sulfur and metals removal because they are absorbed in the solid particles and are removed from the product stream during filtration.

The present invention is practiced by first separating the organic component from tar sands in such a way that there remains in said organic component from about 1 to 20 wt. % native solids. The mixture of organic component and native solids will typically be comprised of from about 0 to 25 wt. % water, about 1 to 20 wt. % native solids, with the balance being the organic component, based on the total weight of the mixture. Preferred mixtures will be comprised of about 2 to 10 wt. %, more preferably about 4 to 8 wt. % native solids, with the balance being the organic component, with water being in the range of about 0–25 wt. %. The native solids are the inert solid particulate material which remains in the organic fraction after initial separation. That is, in the case of mined tar sands, the bitumen is separated from tar sands by the use of hot water, steam and caustic. The hot water loosens, or separates, the bitumen from the solid inorganic material, and an aqueous slurry containing bitumen and solid inorganic fines is obtained. Typically, much of the water and solid particulate material are removed by physical separation techniques such as settling and flotation, thus leaving a bitumen froth. The bitumen froth is comprised of bitumen, together with water and native solids.

In the practice of the present invention, 1 to 20 wt. % of native solids are left in the organic component, with or without water. The organic/water/native solids mixture of the present invention allows thermal conversions far greater than 30 to 35%. By the practice of the present invention, conversion levels of up to about 60% can be obtained. As previously mentioned, such high conversions also results in far greater metals removal and much lower viscosities than would otherwise be achievable at lower conversion levels. It is believed that the primary reason for being able to reach such high conversion levels rests with the fact that any coke-make at conversion levels up to about 60% will be taken up by the native particulate material, instead of being deposited on the process equipment.

The following examples are presented to illustrate the present invention and are not to be taken as limiting in any way.

EXAMPLES

A series of 11 conversion of bitumen experiments were carried out in a small scale pilot plant having a 100 ft coil reactor wherein the tubular comprising the coil had an inside diameter of 0.15 inches. The diameter of the coil was 10 inches with a pitch of 2 inches and with a total volume of 357 $cm^3$. The bitumen samples used for these experiments were in froth form. That is they also contained various amounts of water and native solids. The bitumen froth samples were first preheated to about 70° C. and charged into a 15 gallon mix tank and agitated with a propeller at 350 rpm and recirculated with a pump to ensure a substantially uniform mixture.

The resulting slurry was then pumped into a feed tank which was stirred and recirculated in the same manner as the mix tank to keep the solids suspended in the slurry. The slurry was fed into the coil reactor at various feed rates and gas-treat rates. The effluent from the reactor was first separated in a hot separator maintained at 343° C. then a preheated stripping gas at a measured rate was used to separate the light ends from the heavy ends. The light ends, which included water, chemical gases, light hydrocarbon gases, and oils was further separated in a cold separator. The light hydrocarbon gases were then separated from the water and light oil. The water and light oil were accumulated in a light accumulator. The water and light oil were separated by decantation. The light oil is considered the desired conversion product.

The gases were measured and analyzed. In each series of runs, a four hour coming-on-line condition, at desired reaction temperatures was conducted before starting a yield period. A yield period lasted about 6 hours for material balance purposes. The heavy ends were then submitted for conventional distillation to determine the boiling point conversion. The results were then combined with the boiling point of the light oil determined by gas chromatographic distillations.

The feed was sampled for analysis before each reaction condition. The analysis for the feed is shown in the Table II below. The ash ranged from 2.4–16.1 wt. %, water from 7–31 wt. %, and the bitumen contained about 58 wt. % 525° C+ material.

The operating conditions for the eleven runs are set forth in Table III below. The temperatures ranged from 459°–474° C., the slurry feed rates from 3.1–8.5 lbs/hr, and the reaction pressures from 1000–1300 psig.

The yields are summarized in Table III below. The yields include $C_1$–$C_4$ gases, boiling points break down of the slurry, and total liquids and conversion. The 525° C.+ conversion level was also calculated based on the 525° C.+ material in the feed. The conradson carbon conversion, hydrodesulfurization, hydrodenitrogenation, API gravity, and slurry viscosity without solids are also reported in Table III.

TABLE II

Bitumen Feed Characteristics

| Major Components, | wt. % |
|---|---|
| Carbon | 83.51 |
| Hydrogen | 10.59 |
| Sulfur | 5.37 |
| Nitrogen | 0.52 |
| 525° C.+ Fraction | 56.90 |
| Solids | 6.71 |
| Conradson Carbon | 13.22 |
| **Metals,** | **wppm** |
| Ni | 72 |
| V | 300 |

TABLE III

Conditions and Results for Thermal Conversion Runs

| Run No. | 1 | 2 | 3 | 4 | 5 | 6 | 7 | 8 | 9 | 10 | 11 |
|---|---|---|---|---|---|---|---|---|---|---|---|
| Internal No. | 33 | 34 | 38 | 39 | 40 | 45 | 46 | 47 | 48 | 49 | 50 |
| Temperature, °C. | 459 | 466 | 456 | 457 | 466 | 462 | 461 | 461 | 470 | 470 | 470 |
| Resi. Time, sec | 329 | 324 | 240 | 282 | 195 | 119 | 206 | 232 | 127 | 117 | 128 |
| Feed Rate, lbs/hr. | 3.1 | 3.1 | 4.2 | 3.6 | 5.2 | 8.4 | 4.8 | 4.3 | 7.9 | 8.5 | 7.9 |
| Pressure, psig | 130 | 130 | 979 | 998 | 948 | 100 | 100 | 100 | 100 | 101 | 101 |
| $H_2O$ in Feed | 9.3 | 7.8 | 19.6 | 25.9 | 31.0 | 27.4 | 27.9 | 22.4 | 29.2 | 25.7 | 16.1 |

TABLE III-continued

| Conditions and Results for Thermal Conversion Runs | | | | | | | | | | | |
|---|---|---|---|---|---|---|---|---|---|---|---|
| Yields, wt % DAF[1] | | | | | | | | | | | |
| 525° C. + Conv. | 53.9 | 53.4 | 52.0 | 47.9 | 48.9 | 32.5 | 43.7 | 39.1 | 38.0 | 46.9 | 43.0 |
| Coke (less solids) | 5.8 | 6.9 | 5.7 | 5.5 | 4.2 | 0.8 | 1.1 | 1.5 | 1.2 | 1.0 | 1.5 |
| S removed | 35.2 | 32.4 | 8.9 | 15.4 | 9.1 | 5.7 | 9.9 | 9.9 | 6.0 | 11.6 | 17.7 |
| N removed | 13.7 | 9.1 | 0.0 | 3.5 | 3.7 | 30 | −1.7 | −2.4 | −6.2 | 9.1 | 6.8 |
| Ni removed | 30.8 | 51.5 | 30.0 | 38.6 | 29.8 | 33.8 | 33.4 | 24.4 | 31.7 | 35.6 | 16.0 |
| V removed | 41.3 | 62.5 | 54.9 | 61.2 | 52.7 | 43.8 | 46.4 | 43.9 | 47.5 | 49.3 | 40.3 |
| Solids | 8.1 | 16.1 | 12.7 | 8.5 | 13.1 | 2.6 | 2.4 | 2.9 | 3.5 | 3.9 | 4.5 |
| API (w/o solids) | 16.8 | 15.7 | 13.4 | 14.3 | 12.0 | na | 12.0 | 11.9 | na | 12.2 | 12.6 |
| Viscosity | | | | | | | | | | | |
| CP @ 25° C. | 31 | 38 | 151 | 105 | 451 | 881 | 351 | 438 | 266 | 343 | 224 |
| CP @ 41° C. | 16 | 19 | 68 | 46 | 156 | 489 | 112 | 167 | 153 | 193 | 110 |

[1]DAF = Dry-Ash-Free

What is claimed is:

1. A process for upgrading the organic component of tar sands to lower boiling products, which process comprises:

a) separating the organic component from the inorganic component of tar sands so that the organic component contains from about 2 to 10 wt. % of inorganic tar sands native solids;

b) subjecting said organic component containing the native solids to temperatures from about 425° to 565° C. and pressures from about atmospheric pressure to about 2,000 psig;

c) collecting a normally liquid hydrocarbonaceous product stream, including inorganic native solids; and d) separating the inorganic native solids from the normally liquid product stream.

2. The process of claim 1 wherein up to about 25 wt. % water is present in the mixture.

3. The process of claim 2 wherein the mixture is comprised of about 4 to 8 wt. % solids, about 8 to 12 wt. % water, with the balance being organic component.

4. The process of claim 1 wherein the process conditions include temperatures from about 425° to 510° C., and pressures from about 100 to 1500 psig.

5. The process of claim 3 wherein the process conditions include temperatures from about 425° to 510° C., and pressures from about 100 to 1500 psig, and the organic component is bitumen.

* * * * *